US009797241B2

(12) United States Patent
McRory

(10) Patent No.: US 9,797,241 B2
(45) Date of Patent: Oct. 24, 2017

(54) ACOUSTIC TRANSMITTER FOR TRANSMITTING A SIGNAL THROUGH A DOWNHOLE MEDIUM

(71) Applicant: XACT Downhole Telemetry Inc., Calgary (CA)

(72) Inventor: John Godfrey McRory, Calgary (CA)

(73) Assignee: XACT Downhole Telemetry Inc., Calgary, Alberta (CA)

( * ) Notice: Subject to any disclaimer, the term of this patent is extended or adjusted under 35 U.S.C. 154(b) by 145 days.

(21) Appl. No.: 14/766,421

(22) PCT Filed: Feb. 7, 2014

(86) PCT No.: PCT/CA2014/050087
§ 371 (c)(1),
(2) Date: Aug. 6, 2015

(87) PCT Pub. No.: WO2014/121403
PCT Pub. Date: Aug. 14, 2014

(65) Prior Publication Data

US 2015/0377017 A1 Dec. 31, 2015

(51) Int. Cl.
*E21B 47/16* (2006.01)
*E21B 47/14* (2006.01)
*B06B 1/02* (2006.01)

(52) U.S. Cl.
CPC ..... *E21B 47/16* (2013.01); *B06B 1/0215* (2013.01); *E21B 47/14* (2013.01); *B06B 2201/55* (2013.01); *B06B 2201/73* (2013.01)

(58) Field of Classification Search
CPC ..... B06B 1/0215; B06B 2201/55; B06B 2201/73; E21B 47/14; E21B 47/16
See application file for complete search history.

(56) References Cited

U.S. PATENT DOCUMENTS

| | | | |
|---|---|---|---|
| 4,493,062 | A | 1/1985 | Mallett |
| 4,691,203 | A | 9/1987 | Rubin et al. |
| 5,073,878 | A | 12/1991 | Gilchrist |
| 6,583,729 | B1 | 6/2003 | Gardner et al. |
| 7,088,970 | B2 | 8/2006 | Williams |
| 7,538,473 | B2 | 5/2009 | Blandino et al. |

(Continued)

FOREIGN PATENT DOCUMENTS

| | | | |
|---|---|---|---|
| CA | 2585046 | A1 | 10/2007 |
| EP | 1469161 | A2 | 10/2004 |
| EP | 1731228 | A1 | 12/2006 |

OTHER PUBLICATIONS

Michael Barr, "Introduction to Pulse Width Modulation," http://www.embedded.com/electronics-blogs/beginner-s-corner/4023833/Introduction-to-Pulse-Width-Modulcation, Aug. 31, 2001, 3 pages.

(Continued)

*Primary Examiner* — Sisay Yacob

(74) *Attorney, Agent, or Firm* — Klarquist Sparkman, LLP

(57) ABSTRACT

An acoustic transmitter for transmitting an acoustic signal through a downhole medium includes a voltage source; a composite load; and switching circuitry that applies voltage from the voltage source across the composite load in response to a drive signal. The composite load includes charge control circuitry, in the form of at least one inductor, connected electrically in series with a piezoelectric transducer that may be electrically modeled as a capacitor.

30 Claims, 7 Drawing Sheets

(56) References Cited

U.S. PATENT DOCUMENTS

| | | | | |
|---|---|---|---|---|
| 2005/0219040 | A1* | 10/2005 | Dryer | G08B 3/10 340/384.71 |
| 2007/0030762 | A1 | 2/2007 | Huang et al. | |
| 2007/0046143 | A1* | 3/2007 | Blandino | H01L 41/042 310/317 |
| 2007/0227776 | A1* | 10/2007 | Huang | E21B 41/0085 175/42 |
| 2009/0038848 | A1* | 2/2009 | Garcia-Osuna | E21B 17/003 175/40 |

OTHER PUBLICATIONS

Douglas S. Drumheller, "Acoustic Properties of Drill Strings," *J. Acoustical Society of America*, vol. 85, No. 3, Mar. 1989, pp. 1048-1064.

Mohan, et al., "Power Electronics: Converters, Applications and Design," Third Edition, John Wiley & Sons, Inc., 2003, pp. 188-195.

Pressman, et al., "Switching Power Supply Design," McGraw-Hill Companies, 2009, pp. 30-41.

Yang, et al., "Class D Power Amplifier for Audio Beam System," IEEE International Conference on Mechatronics and Automation, Harbin, China, Aug. 5-8, 2007, 6 pages.

International Search Report and Written Opinion of the International Searching Authority, dated Apr. 29, 2014, for corresponding International Application No. PCT/CA2014/050087, 9 pages.

Search Report from the European Patent Office for corresponding European Application No. EP14749094.0-1559, dated Aug. 25, 2016, 8 pages.

* cited by examiner

ACOUSTIC TRANSMITTER FOR TRANSMITTING A SIGNAL THROUGH A DOWNHOLE MEDIUM

CROSS REFERENCE TO RELATED APPLICATIONS

This is the U.S. National Stage of International Application No. PCT/CA2014/050087, filed Feb. 7, 2014, which in turn claims the benefit of and priority to provisional U.S. Pat. Application No. 61/762,186, filed Feb. 7, 2013.

TECHNICAL FIELD

The present disclosure is directed at an acoustic transmitter for transmitting a signal through a downhole medium.

BACKGROUND

Modem drilling techniques for oil wells and oil fields often involve transmitting drilling data between transmission points along a drillstring in real-time. Various sensory devices may be provided along the drillstring so that drilling data such as downhole temperature, downhole pressure, drill bit orientation, drill bit RPM, formation data, etc., may be transmitted along the drillstring towards the surface or further downhole. For example, the drilling data may be sent to a surface controller that updates drilling parameters using the drilling data in order to improve control and efficiency of the drilling operation. Real-time transmission of drilling data during drilling operations may occur when performing measurement-while-drilling (MWD), for example. Given the prevalence of MWD, efforts continue to improve upon conventional methods and apparatuses for transmitting drilling data.

SUMMARY

According to a first aspect, there is provided an acoustic transmitter for transmitting an acoustic signal through a downhole medium, the transmitter comprising a voltage source; a piezoelectric transducer; charge control circuitry, comprising at least one inductor, connected in series with the piezoelectric transducer, the piezoelectric transducer and the charge control circuitry collectively comprising a composite load; and switching circuitry, which comprises (i) a control terminal for receiving a drive signal; (ii) a supply terminal connected to the voltage source; and (iii) a pair of output terminals across which the composite load is connected, wherein voltage from the voltage source is applied across the output terminals in response to the drive signal.

The charge control circuitry may comprise a pair of inductors having equal inductances, with the piezoelectric transducer connected in series between the pair of inductors. Alternatively, the charge control circuitry may comprise two groups of inductors having equal inductances, with the piezoelectric transducer connected in series between the two groups of inductors.

The composite load may have a series resonant frequency that is at least approximately four times the frequency of the acoustic signal.

The inductances of the inductors may be selected such that total inductance of the composite load permits the transmitter to have a slew rate sufficient for the frequency of the acoustic signal. For example, the at least one inductor may have an inductance L as follows:

The at least one inductor may have an inductance L as follows:

$$L = \frac{V_s}{V_p}\frac{T}{2\omega C}$$

wherein $V_s$ is the magnitude of the voltage from the voltage source, $V_p$ is a maximum voltage applied across the piezoelectric transducer, T is a period of the drive signal, C is a capacitance of the piezoelectric transducer, and ω is a radial frequency of the acoustic signal.

The voltage may be applied across the output terminals in a forward polarity when the drive signal is in a first state, and in a reverse polarity when the drive signal is in a second state.

The switching circuitry may comprise an H-bridge comprising power transistors as switches and a freewheeling diode placed across the output terminals of each of the power transistors.

The transmitter may further comprise one or both of a controller connected to the control terminal that outputs a pulse wave modulation signal as the drive signal, and a battery electrically coupled to a DC to DC voltage converter whose output is connected to the supply terminal.

According to another aspect, there is provided an acoustic transmission system for transmitting an acoustic signal through a downhole medium, the system comprising a transmitter for transmitting the acoustic signal, a receiver for receiving the acoustic signal after it has propagated through the transmission medium, and a demodulator communicatively coupled to the receiver and configured to recover the data signal from the received acoustic signal. The transmitter may comprise a voltage source; a piezoelectric transducer; charge control circuitry, comprising at least one inductor, connected in series with the piezoelectric transducer, the piezoelectric transducer and the charge control circuitry collectively comprising a composite load; and switching circuitry comprising (i) a control terminal for receiving a drive signal; (ii) a supply terminal connected to the voltage source; and (iii) a pair of output terminals across which the composite load is connected, wherein voltage from the voltage source is applied across the output terminals in response to the drive signal.

According to another aspect, there is provided a method for transmitting an acoustic signal through a downhole medium, the method comprising applying a voltage across a composite load comprising at least one inductor and a piezoelectric transducer connected in series with the at least one inductor in order to generate the acoustic signal; and directing the acoustic signal into the downhole medium.

The composite load may comprise a pair of inductors having equal inductances, with the piezoelectric transducer connected in series between the pair of inductors. Alternatively, the composite load may comprise two groups of inductors having equal inductances, with the piezoelectric transducer connected in series between the two groups of inductors.

The composite load may have a series resonant frequency that is at least approximately four times the frequency of the acoustic signal.

The at least one inductor may be selected such that total inductance of the composite load permits the transmitter to have a slew rate sufficient for the frequency of the acoustic signal. For example, the at least one inductor may have an inductance L as follows:

The at least one inductor may have an inductance L as follows:

$$L = \frac{V_s}{V_p}\frac{T}{2\omega C}$$

wherein $V_s$ is the magnitude of the voltage from the voltage source, $V_p$ is a maximum voltage applied across the piezoelectric transducer, T is a period of the drive signal, C is a capacitance of the piezoelectric transducer, and ω is a radial frequency of the acoustic signal.

The voltage may be applied to the composite load via switching circuitry controlled by a drive signal, the voltage being applied across the composite load in a forward polarity when the drive signal is in a first state and in a reverse polarity when the drive signal is in a second state.

The switching circuitry may comprise an H-bridge comprising power transistors as switches and a freewheeling diode placed across the output terminals of each of the power transistors.

The drive signal may be modulated using pulse wave modulation.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

Figure 1:
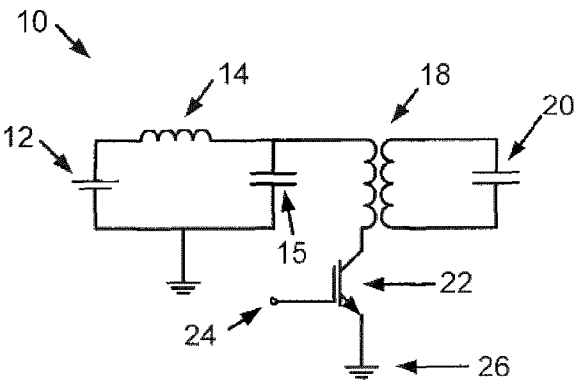
FIG. 1 (PRIOR ART)
FIG. 1 is a schematic of a transformer-based resonating acoustic transmitter according to the PRIOR ART.

Directional terms such as "top", "bottom", "upwards", "downwards", "vertically", and "laterally" are used in the following description for the purpose of providing relative reference only, and are not intended to suggest any limitations on how any article is to be positioned during use, or to be mounted in an assembly or relative to an environment. Additionally, the term "couple" and variants of it such as "coupled", "couples", and "coupling" as used in this description is intended to include indirect and direct connections unless otherwise indicated. For example, if a first device is coupled to a second device, that coupling may be through a direct connection or through an indirect connection via other devices and connections. Similarly, if the first device is communicatively coupled to the second device, communication may be through a direct connection or through an indirect connection via other devices and connections.

Data may be transmitted during oil and gas drilling operations using any one of several techniques. For example, data may be transmitted using acoustic telemetry, in which an acoustic signal propagates as a wave along a transmission medium such as a drill string. Alternatively, data may be transmitted using mud-pulse telemetry, in which the data is encoded as pressure pulses that are transmitted via the drilling fluid or mud. Also alternatively, wireline telemetry may be used, in which data is transmitted in the form of electrical signals along cables. The embodiments described herein are directed at acoustic telemetry.

Acoustic telemetry typically permits communication at a higher data rate than competing technologies such as mud pulse and electromagnetic telemetry, is unaffected by the characteristics of the formations surrounding the drillstring, and also offers an unobstructed tool bore that facilitates ease of operation. Data transmitted using acoustic telemetry is carried by an acoustic signal comprising mechanical, extensional waves that are launched into the drill pipe by an electromechanical transducer located either within a downhole tool or from the surface.

A piezoelectric stack is commonly used as the electromechanical transducer that launches the extensional waves into the drill pipe. The stack comprises a series of thin piezoelectric discs that are mounted on a mandrel and constrained between two metal shoulders. Electrically the discs are connected in parallel with thin metal electrodes interleaved between the discs. As a result the stack's electrical behavior is primarily capacitive. Applying a high voltage charges the stack and causes it to increase or decrease in length. It is this deflection that launches the extensional waves into the drill pipe.

It is generally recognized that the periodic structure of drillstring creates a structure whose frequency response may be characterized as a comb filter comprising a series of passbands alternating with stopbands (D.S. Drumheller, *Acoustic Properties of Drill Strings*, J. Acoustical Society of America, 85: 1048-1064, 1989), and that acoustic signals will propagate within one or more of the passbands. Accordingly, the acoustic signal comprises one or more carrier waves at frequencies within one or more passbands of the drillstring that may be modulated so as to transmit data (for example, downhole sensor data or uphole/downhole control data) along the drillstring. However, due to the need for increasing data rates and the bandwidth limitations of the drillstring it is often desirable to transmit digitally encoded signals with an increased number of bits per symbol. The desired acoustic signal may therefore comprise a complex waveform requiring considerable power to generate. Existing downhole acoustic transmitters, however, are limited in their ability to produce acoustic signals with complex waveforms, and fail to efficiently utilize the limited power resources available downhole.

FIG. 1 is an example prior art acoustic transmitter 10 that may be implemented within a downhole drilling tool, such as in an MWD tool that forms part of a bottomhole assembly. The transmitter 10 comprises a battery 12 connected in series to an inductor 14 and a capacitor 15. The transmitter 10 also comprises a transformer 18 whose primary winding on one terminal is electrically connected between the inductor 14 and capacitor 15 and on the other terminal is connected to the collector of an insulated gate bipolar junction (IGBT) transistor 22. The transistor's 22 emitter is connected to ground.

The transformer's 18 secondary winding is connected in parallel to another capacitor 20, which models the piezoelectric stack used to generate the acoustic signal (the capacitor 20 is hereinafter the "stack capacitor 20"). The transformer's 18 secondary winding and the stack capacitor 20 collectively comprise a parallel LC circuit. The transformer's 18 secondary winding is tapped at a location so that the parallel LC circuit is in resonance when operated at a frequency that falls within one of the acoustic passbands of the drillstring.

In order to operate the transmitter 10 to transmit a sinusoidal waveform the parallel LC circuit is subjected to a series of current impulses. Each impulse is created by momentarily connecting the battery 12 to ground through the primary winding of the transformer 18 by applying a voltage to the transistor's 22 gate 24 sufficient to switch the transistor 22 on. This in turn excites the parallel LC circuit to oscillate at its natural frequency. The impulses are separated by the duration of one full cycle of the desired output frequency of the acoustic signal and the timing of the impulses can force the acoustic signal to be either higher or lower in frequency than the natural frequency of the parallel LC circuit. Decreasing the time between impulses increases the output frequency while increasing the time between impulses reduces the output frequency.

The transmitter 10 of FIG. 1 has several deficiencies. For example:

(a) operating the parallel LC circuit at resonance limits the acoustic signal to having a constant envelope;
(b) the bandwidth of the acoustic signal is limited by the electrical quality factor ("Q") of the parallel LC circuit;
(c) the electrical efficiency of the transmitter 10 decreases as the frequency of operation deviates from the resonant frequency of the parallel LC circuit and the magnitude of the electrical impedance of the parallel LC circuit consequently decreases; and
(d) relying on the transformer 18 for driving the piezoelectric stack results in significant energy losses through heat dissipation in the transformer windings, core, and surrounding structures, and also places significant strain on the limited power resources of the downhole tool.

Accordingly, the following embodiments are directed at an acoustic transmitter that overcomes at least one of the above limitations. For example, the following embodiments include one or more of the following features:

(a) the use of digital and solid-state components, which preclude the requirement for a transformer and consequently increase power efficiency and reduce the size of the transmitter;
(b) the ability to generate acoustic signals that have been modulated using techniques other than constant envelope frequency or phase modulation; and
(c) the ability to generate acoustic signals for transmission over any one or more of the drillstring's frequency passbands, thereby permitting use of a greater proportion of the drillstring's bandwidth for data transmission.

Acoustic Transmitter Block Diagram

Figure 2:
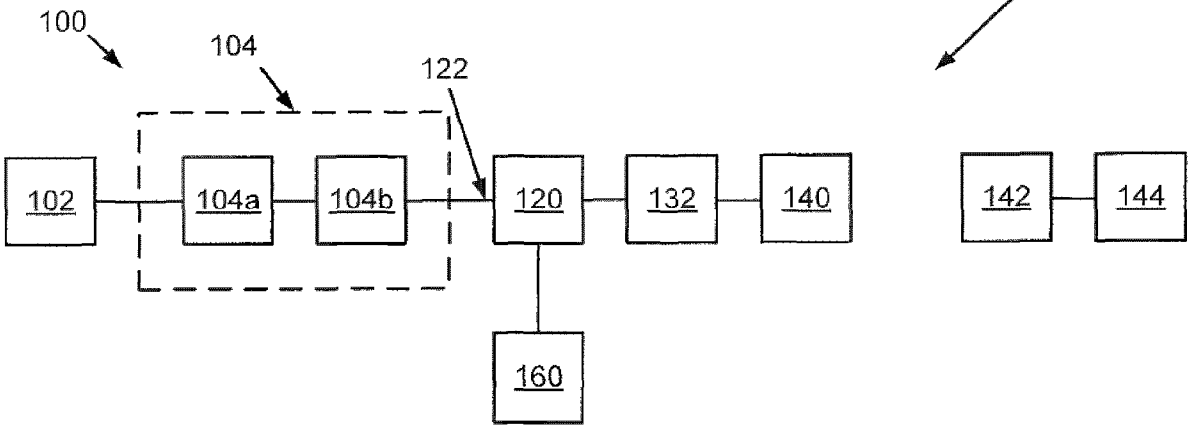
FIG. 2 is a block diagram of an acoustic transmission system comprising a solid-state acoustic transmitter, according to one embodiment.

FIG. 2 is a block diagram of an acoustic transmission system 101, according to one embodiment. The acoustic transmission system 101 comprises an acoustic transmitter 100, a receiver 142 configured to receive the acoustic signal after it has been transmitted through the drillstring, and a demodulator 144 communicatively coupled to the receiver 142 to recover transmitted data. The transmitter 100 comprises a battery 102, a voltage converter 104, switching circuitry 120, stack charge control circuitry 132, a piezoelectric transducer 140, and a controller 160. The battery 102 may comprise a portable low voltage DC tool battery, such as a 32V battery. The voltage converter 104 may comprise a single or multiple stage DC/DC voltage converter coupled to the battery 102 for increasing the battery voltage to a suitable supply voltage for eventual application to the piezoelectric transducer 140. For example, in FIG. 2 the voltage converter 104 comprises multiple stages: a first stage DC/DC converter 104*a* amplifying a 32V battery output to 90V, and a second stage DC/DC converter 104*b* amplifying the 90V first stage output to 500V. The voltage converter 104 supplies power to the switching circuitry 120. As described below, the switching circuitry 120 applies the voltage that the voltage converter 104 outputs to the piezoelectric transducer 140 through the charge control circuitry 132 in accordance with a pulse wave modulation (PWM) drive signal sent by the controller 160 to a control terminal of the switching circuitry 120. As discussed in more detail in FIG. 4 below, the charge control circuitry 132 in the depicted embodiments comprises a symmetric pair of inductors used to accurately control the charge delivered to the transducer 140 over each clock cycle of the PWM drive signal. A "symmetric pair" of inductors refers to a pair of inductors having substantially equal inductances, with one of the inductors connected to one terminal of the transducer 140 and the other inductor connected to the other terminal of the transducer 140.

In the depicted example embodiment the controller 160 comprises a digital signal processor that outputs the PWM drive signal, but in alternative embodiments may comprise a processor, microcontroller, or other suitable analog, digital, or mixed signal circuit, such as a pulse-width modulator capable of providing the drive signal. The use of controlled packets of charge, regulated by the charge control circuitry 132 as discussed in relation to Equations 1 through 5 below, to drive the piezoelectric transducer 140 allows for the generation of varied and complex acoustic signals, including those with non-constant envelopes and those that transmit data using the drillstring's different passbands.

Figure 3:
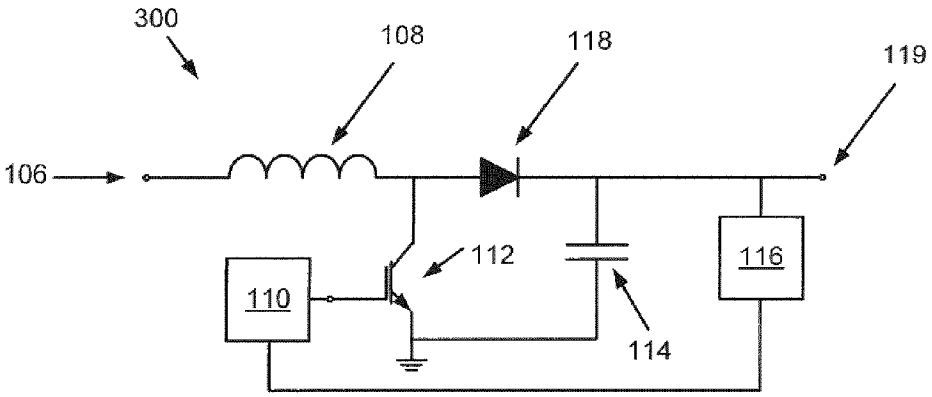
FIG. 3 is a schematic of a DC/DC converter comprising part of the acoustic transmitter of FIG. 2.

FIG. 3 is an example schematic diagram of a simple DC/DC boost converter 300 that may be used as either of the first or second stage DC/DC converters 104*a*, 104*b*. The converter 300 comprises an input voltage terminal 106 electrically connected in series to an inductor 108 and a diode 118. The output of the diode 118 is the boost converter's 300 output terminal 119. The collector of an IGBT junction transistor 112 ("driving transistor 112") is connected between the inductor 108 and the diode 118, and the driving transistor's 112 emitter is connected to ground. The output terminal 119 is also connected to ground via a capacitor 114. Voltage sensing circuitry 116 is connected to the output terminal 119 and a pulse modulator is connected to the driving transistor's 112 gate. The voltage sensing circuitry 116 and output terminal 119 are connected to each other in series and collective comprise a feedback loop that maintains the output terminal at a desired voltage. The operation of the boost switching converter 300 is well understood by those versed in the art, and is described in detail in *Switching Power Supply Design*, A. Pressman et al., pp 31-40.

Switching Circuitry

Figure 4:
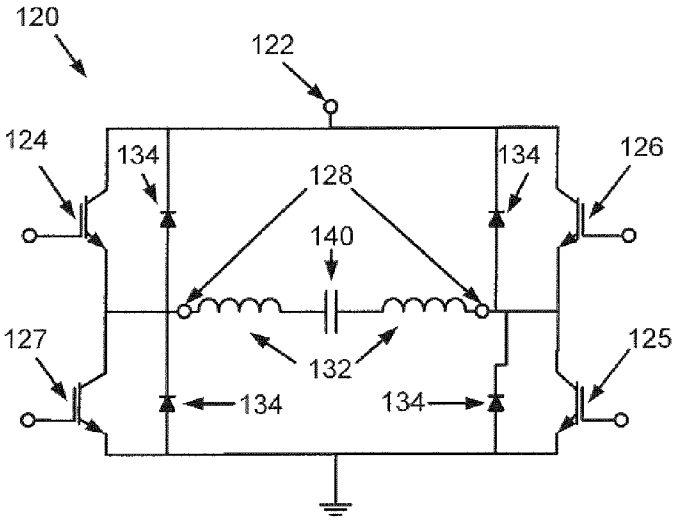
FIG. 4 is a schematic of switching circuitry comprising part of the acoustic transmitter of FIG. 2.

FIG. 4 is an embodiment of the switching circuitry 120 comprising part of the transmitter 100 of FIG. 2. The switching circuitry 120 comprises an H-bridge that has a supply terminal 122 that is couplable to a voltage source, such as the output of the voltage converter 120. The H-bridge also comprises a first pair of diagonally opposed transistors 124,125, a second pair of diagonally opposed transistors 126,127, and a pair of output terminals 128 that are electrically connected across the charge control circuitry 132 and the piezoelectric stack 140, which are connected together in series. The transistors 124,125,126,127 may be any suitable type of high voltage switching device, such as MOSFETs or BJTs, but in the depicted example embodiment are shown as IGBTs. Each of the transistors 124,125,126,127 is driven by suitable high-side and low-side drivers (not shown); an example driver is the International Rectifier™ IR2112 driver. The transistors' 124,125,126,127 gates collectively comprise the control terminal of the switching circuitry 120, and the signal applied to these gates varies in response to the drive signal the controller 160 outputs. When the drive signal turns the first pair of diagonally opposed transistors 124,125 on and the second pair of diagonally opposed transistors 126,127 off, voltage from the voltage source is applied across the output terminals in a forward polarity; conversely, when the drive signal turns the first pair of diagonally opposed transistors 124,125 off and the second pair of diagonally opposed transistors 126,127 on, voltage from the voltage source is applied across the output terminals in a reverse polarity. The switching circuitry 120 also comprises four freewheeling diodes 134, one of which is connected across the collector and emitter of each of the transistors 124,125,126,127.

While the switching circuitry 120 shown in FIG. 4 comprises an H-bridge, in other embodiments (not depicted) alternative switching circuitry may be used; for example, the switching circuitry 120 may alternatively comprise a half-bridge circuit, a mechanical switching circuit, or a functionally equivalent transistor based switching circuit.

Charge Control Circuitry

The composite load comprising the charge control circuitry 132 and the piezoelectric stack 140 are connected across the H-bridge's output terminals 128. This embodiment of the charge control circuitry 132 comprises the symmetric pair of inductors, with one inductor connected to one terminal of the piezoelectric stack 140 and the other inductor connected to the other terminal of the piezoelectric stack 140. While the depicted embodiment shows the charge control circuitry 132 comprising only two inductors, in alternative embodiments (not depicted) one or both of these inductors comprising the symmetric pair may be replaced with a group of inductors electrically connected together in series. In the depicted example embodiment, the series LC resonance created by the inductors and the piezoelectric stack 140 is well above the frequency of the acoustic signal; in FIG. 4, the series resonant frequency of the composite load is approximately four times the frequency of acoustic signal. The inductances of the inductors are selected such that total inductance of the composite load permits the transmitter to have a slew rate sufficient for the frequency of the acoustic signal, as discussed in more detail below. Further, the inductors are not used to create a low pass filter with a resistive load as is found in amplifier classes D and E. The size of the inductors is determined by the desired step response in the current of the series LC circuit.

Pulse Width Modulation (PWM) is a common modulation method used to drive an H-bridge in applications such as motor control or electronic voltage converters. The generation of a PWM control signal and the operation of an H-bridge are well understood by those versed in the art and are documented in detail in several references including *Power Electronics: Converters, Applications and Design*; Mohan, Underland and Robbins; pp. 188-194.

In this embodiment a PWM representation of the desired acoustic waveform is used to drive the H-bridge. The composite load, which is a series LC circuit comprising the piezoelectric stack 140 electrically connected between the two inductors that comprise the charge control circuitry 132, is connected across the output terminals 128 and is subject to a series of alternating rectangular voltage steps at the level of $\pm V_s$ applied to the supply terminal 122 with a duty cycle determined by the PWM signal. The resulting current waveform through the composite load is a function of the step response of the composite load, which in turn is determined by the value of the series inductors given a fixed capacitive value for the piezoelectric stack 140. The amount of charge transferred to the piezoelectric stack 140 during a cycle of the PWM waveform can be controlled by the correct sizing of the series inductors, as discussed below in respect of Equations 1 through 5, which in turn indirectly controls the stack's 140 voltage and deflection.

Figure 6:
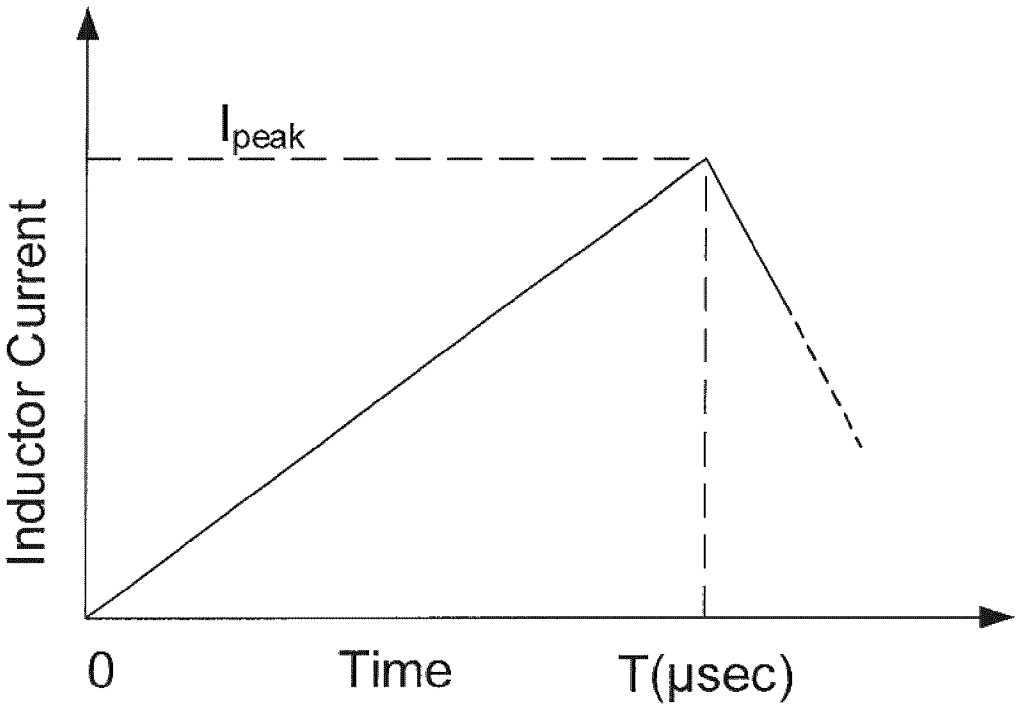
FIG. 6 is a graph of current through a charge control inductor vs. time, the charge control inductor comprising part of the switching circuitry of FIG. 4 and the current resulting from an applied step in inductor voltage.

The step function of the series LC circuit can be simplified if the clock period T for the PWM signal is short enough that a simple linear approximation for the inductor current can be used. Referring to FIG. 6, for a given inductor value L the inductor current arising from a step in inductor voltage ($V_{ind}$) for small values of T can be approximated as linear with a slope of $V_{ind}/L$. The peak value of the current waveform at time T can be approximated as:

$$I_{peak} \cong \frac{V_{ind}T}{L} \tag{1}$$

Figure 7:
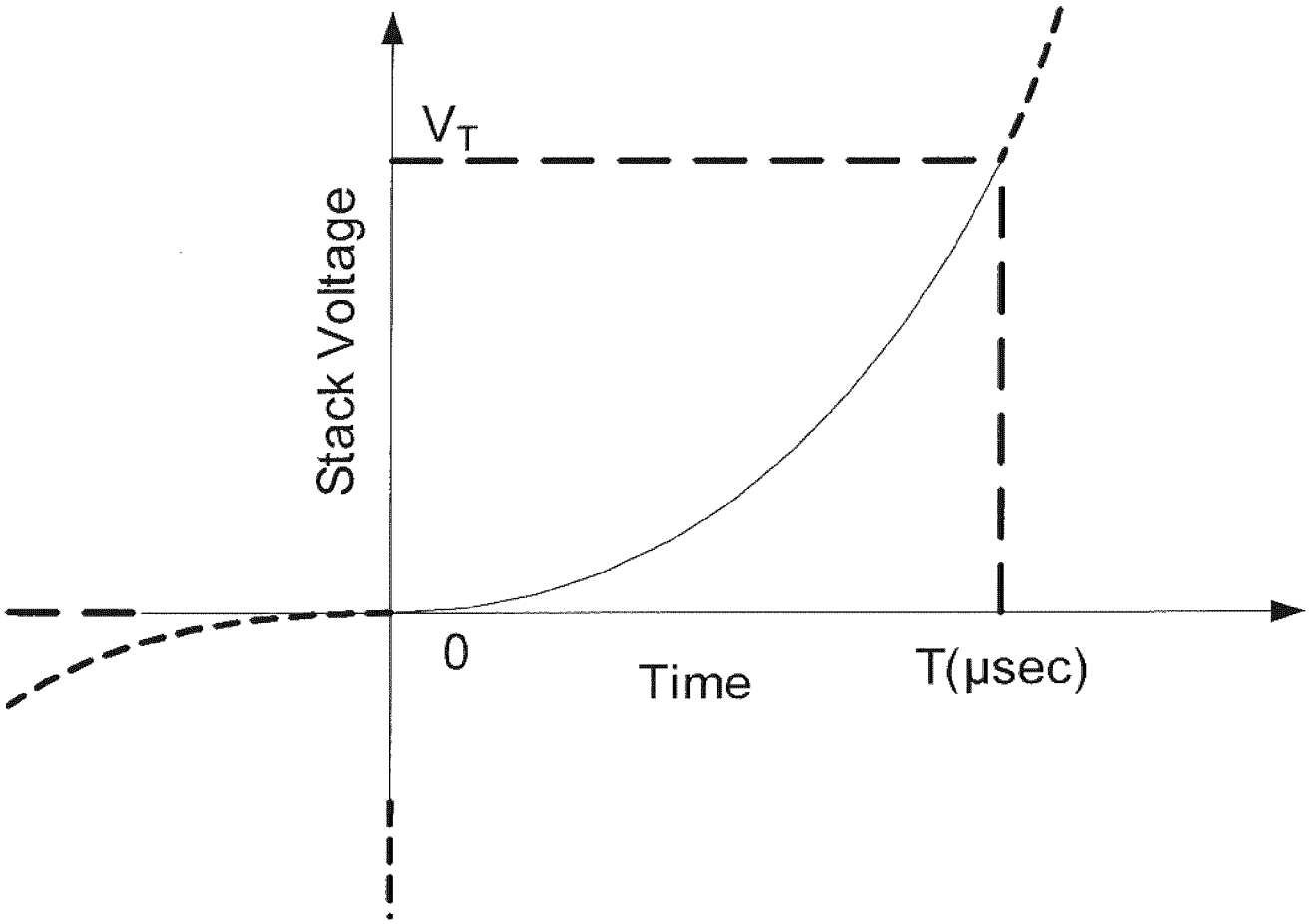
FIG. 7 is a graph of the voltage across a piezoelectric stack vs. time, the piezoelectric stack comprising part of the acoustic transmitter of FIG. 2.

Again referring to FIG. 6, the amount of charge Q that flows into the piezoelectric stack 140 over time T is equal to the integral of the current over T, or in this case is simply the area under the inductor current waveform, as expressed in Equations 2 and 3. The change in voltage across the piezoelectric stack 140 due to the change in charge is shown in FIG. 7.

$$Q = \int_0^T I_L\,dt \cong \frac{I_{peak}T}{2} \tag{2}$$

$$Q \cong \frac{V_{ind}T^2}{2L} \tag{3}$$

Assuming a sinusoidal voltage across the piezoelectric stack 140 of $V_{stack}=V_p\sin(\omega t)$ in which ω is the desired radial frequency of the acoustic signal and $V_p$ is the maximum signal voltage across the piezoelectric stack 140, the maximum voltage slew rate and greatest current draw occurs at the zero crossing point of $V_{stack}$. Assuming a sufficiently small value of ωT, the incremental stack voltage required during the clock cycle T starting at t=0 can be approximated as:

$$V_T=V_p\sin(\omega T)\cong V_p\omega T \tag{4}$$

Then given the capacitance C of the stack 140 and the supply voltage $V_s$, the total series inductance L of the charge control circuitry 132 and consequently the composite load can be shown to be:

$$L = \frac{V_s}{V_p}\frac{T}{2\omega C} \quad (5)$$

If the total series inductance L were zero, the voltage across the piezoelectric transducer 140 would follow that of the drive signal. Conversely, if the total series inductance L were too high, the voltage across the piezoelectric transducer 140 would be unable to transition quickly enough to accommodate the slew rate required by the acoustic signal. Selecting the total series inductance L in accordance with Equation 5 allows the voltage across the piezoelectric stack 140 to deviate from the drive signal, yet still be sufficiently responsive to the drive signal to accommodate the acoustic signal slew rate.

Figure 8:
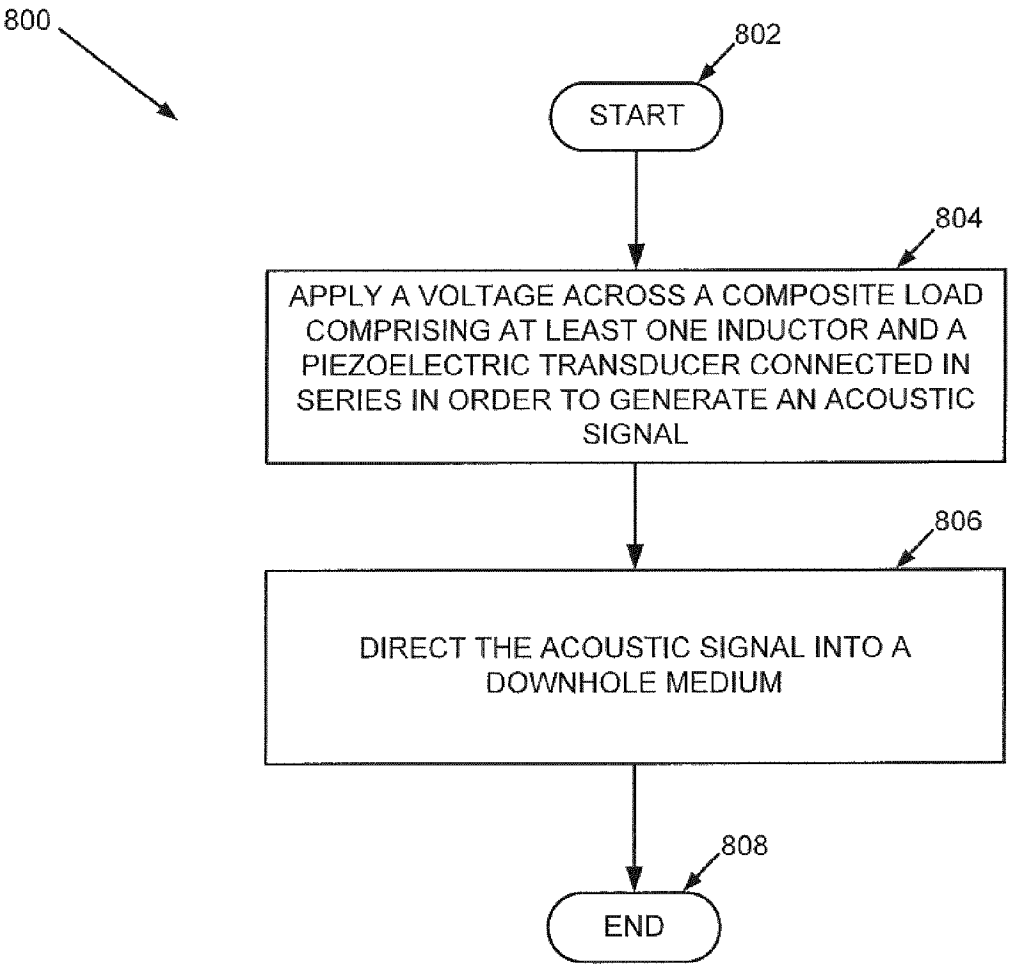
FIG. 8 is a flowchart depicting a method for transmitting an acoustic signal through a downhole medium, according to another embodiment.

Referring now to FIG. 8, there is shown an example method 800 for transmitting an acoustic signal through a downhole medium, according to another embodiment. The method 800 begins at block 802 and proceeds to block 804 where the voltage from the voltage source is applied across the composite load, which comprises the charge control circuitry 132 in series with the piezoelectric transducer 140, in order to generate the acoustic signal as discussed above in relation to FIGS. 1 though 4, 6, and 7. At block 804 the acoustic signal is directed into a downhole medium, such as the drillstring. For example, when the piezoelectric transducer 140 is axially constrained between two metal shoulders comprising part of the drillstring, applying the voltage across the transducer 140 axially expands and contracts the transducer 140, which accordingly moves the metal shoulders and launches the acoustic signal into the drillstring. At block 808 the method 800 ends.

Figure 5A:
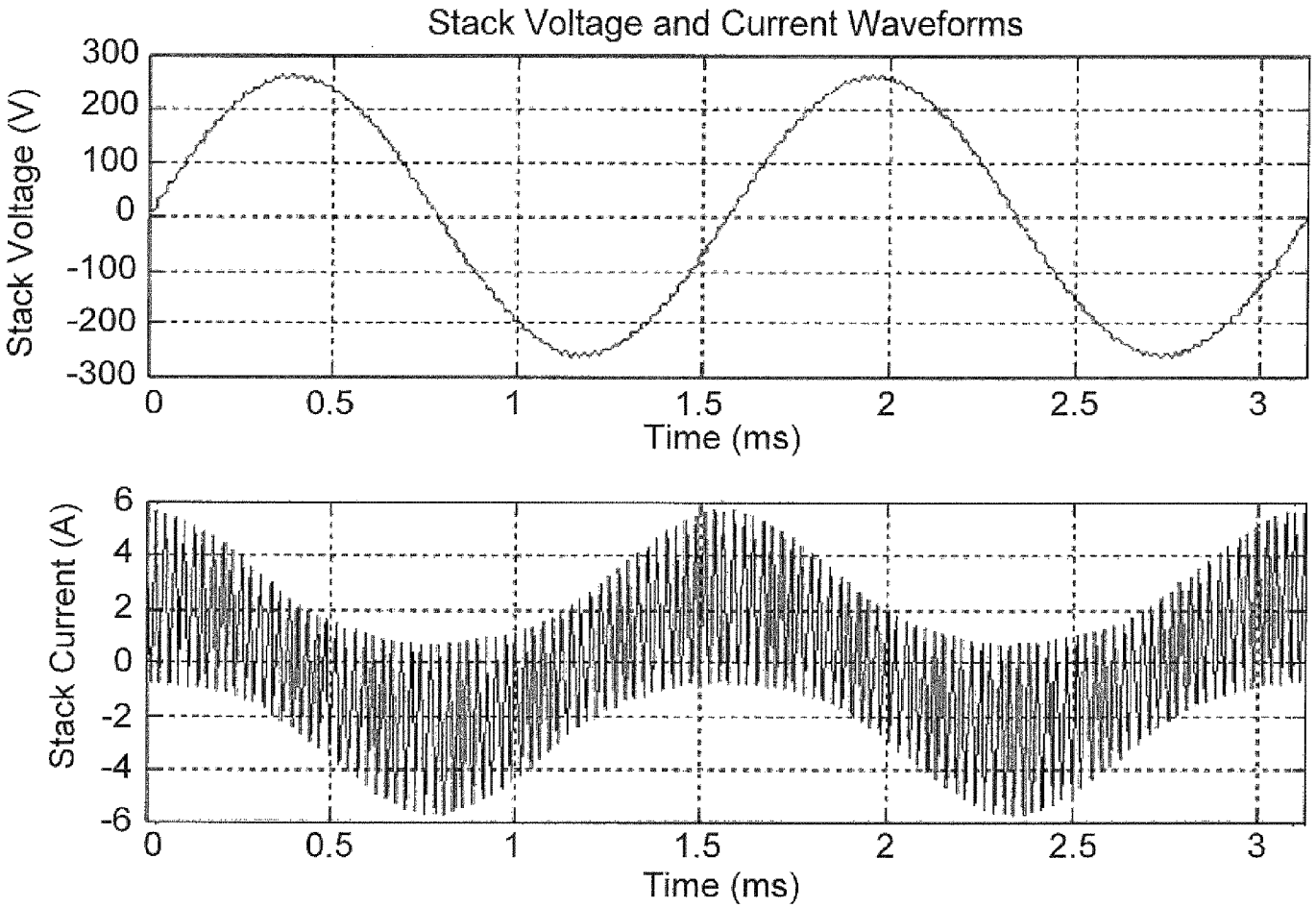
FIGS. 5A and 5B show graphs of voltage vs. time and current vs. time for a piezoelectric stack comprising part of the acoustic transmitter of FIG. 2.

FIG. 5A is a plot of the results of a simulation of the switching circuitry 120 shown in FIG. 4 and shows the control of current through the inductors (and to the piezoelectric transducer 140), and the resulting voltage waveform 138 across the piezoelectric transducer 140. In this example, the supply voltage is 500V DC, the piezoelectric transducer 140 is represented as a capacitance of 2.33 μF, and the inductors each have an inductance of 500 μH. The simulation shows that selective control of current to the piezoelectric transducer 140 using the switching circuitry 120 produces a substantially sinusoidal high voltage waveform across the piezoelectric transducer 140, which in turn launches an extensional wave into the drill pipe.

Figure 5B:
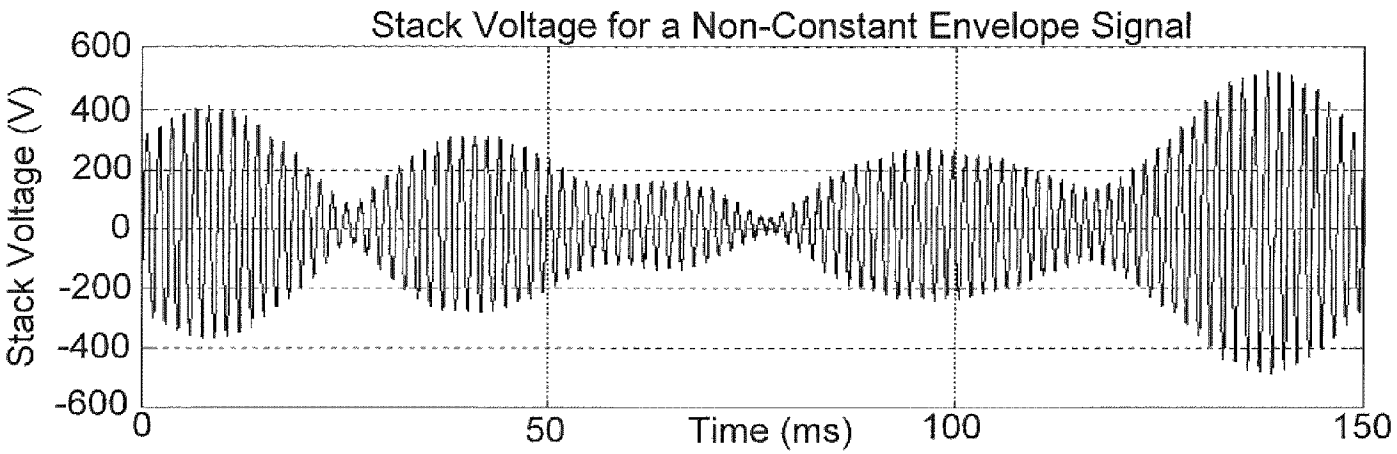
Figure 5B:
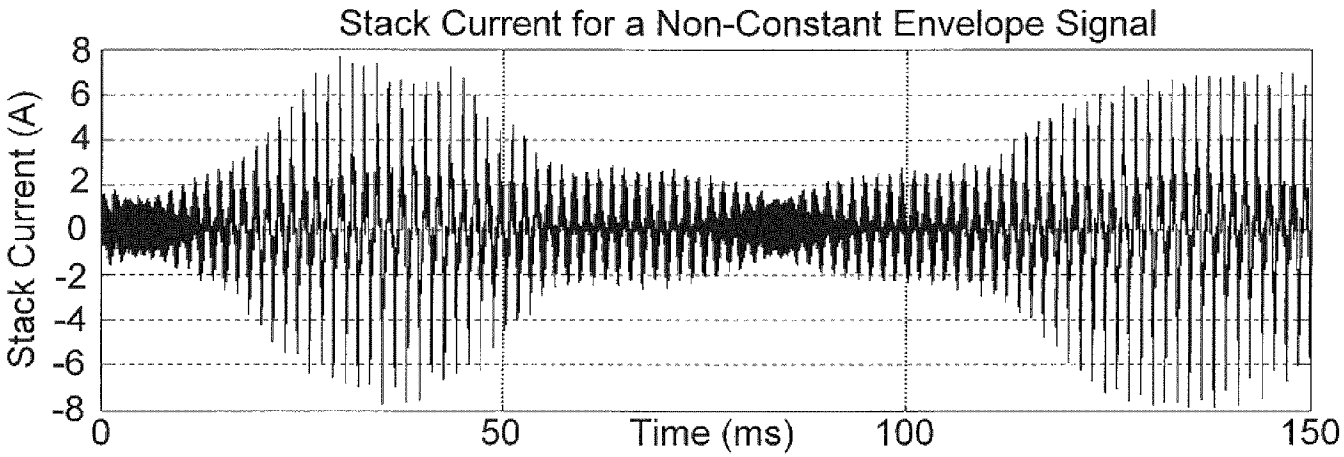

FIG. 5B shows plots of voltage measured across the piezoelectric stack 140 and of current through the inductors (and to the piezoelectric transducer 140), again using the switching circuitry 120 of FIG. 4 according to another embodiment. In this example, the supply voltage is 500V DC, the piezoelectric transducer 140 is represented as a capacitance of 2.33 μF, and the inductors each have an inductance of 940 μH. This example illustrates the versatility of the acoustic transmitter 100 in that it is able to generate an acoustic signal with a non-constant envelope.

For the sake of convenience, the example embodiments above are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or features of the flexible interface can be implemented by themselves, or in combination with other operations in either hardware or software.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A drilling tool comprising an acoustic transmitter for transmitting an acoustic signal through a drillstring, the transmitter comprising:

(a) a voltage source;

(b) a piezoelectric transducer and two metal shoulders constraining the piezoelectric transducer, the metal shoulders launching the acoustic signal into the drillstring when the piezoelectric transducer expands and contracts;

(c) charge control circuitry comprising a pair of inductors, wherein the piezoelectric transducer is connected in series between the pair of inductors, the piezoelectric transducer and the charge control circuitry collectively comprising a composite load; and (d) switching circuitry comprising:

(i) a control terminal for receiving a drive signal;

(ii) a supply terminal connected to the voltage source; and (iii) a pair of output terminals across which the composite load is connected, wherein voltage from the voltage source is applied across the output terminals in response to the drive signal, wherein the composite load has a series resonant frequency that is at least four times the frequency of the acoustic signal.

2. The drilling tool of claim 1, wherein the pair of inductors have equal inductances.

3. The drilling tool of claim 1, wherein the charge control circuitry comprises two groups of inductors having equal inductances, and wherein one of the two groups of inductors comprises one of the pair of inductors and the other of the two groups of inductors comprises the other of the pair of inductors.

4. The drilling tool of claim 2, wherein the inductances of the inductors are selected such that total inductance of the composite load permits the transmitter to have a slew rate sufficient for the frequency of the acoustic signal.

5. The drilling tool of claim 1, wherein the voltage is applied across the output terminals in a forward polarity when the drive signal is in a first state, and the voltage is applied across the output terminals in a reverse polarity when the drive signal is in a second state.

6. The drilling tool of claim 1, wherein the switching circuitry comprises an H-bridge comprising power transistors as switches and a freewheeling diode placed across the output terminals of each of the power transistors.

7. The drilling tool of claim 1, further comprising a controller connected to the control terminal that outputs a pulse width modulation signal as the drive signal.

8. The drilling tool of claim 1, further comprising a battery electrically coupled to a DC to DC voltage converter whose output is connected to the supply terminal.

9. An acoustic transmission system for transmitting an acoustic signal through a drillstring, the system comprising:

(a) a transmitter located either within a downhole tool or on surface, the transmitter comprising:

(i) a voltage source;

(ii) a piezoelectric transducer and two metal shoulders constraining the piezoelectric transducer, the metal shoulders launching the acoustic signal into the drillstring when the piezoelectric transducer expands and contracts;

(iii) charge control circuitry comprising a pair of inductors, wherein the piezoelectric transducer is connected in series between the pair of inductors, the piezoelectric transducer and the charge control circuitry collectively comprising a composite load; and (iv) switching circuitry comprising:

(1) a control terminal for receiving a drive signal;

(2) a supply terminal connected to the voltage source; and (3) a pair of output terminals across which the composite load is connected, wherein voltage from the voltage source is applied across the output terminals in response to the drive signal;

(b) a receiver located within the downhole tool when the transmitter is on surface and located on surface when the transmitter is within the downhole tool, the receiver configured to receive the acoustic signal after propagating through the drillstring; and (c) a demodulator communicatively coupled to the receiver and configured to recover transmitted data from the received acoustic signal, wherein the composite load has a series resonant frequency that is at least four times the frequency of the acoustic signal.

10. A method for transmitting an acoustic signal through a drillstring, the method comprising applying a voltage across a composite load comprising a pair of inductors and a piezoelectric transducer connected in series between the pair of inductors in order to generate the acoustic signal, the piezoelectric transducer constrained by metal shoulders that launch the acoustic signal into the drillstring when the piezoelectric transducer expands and contracts in response to the voltage, wherein the composite load has a series resonant frequency that is at least four times the frequency of the acoustic signal.

11. The method of claim 10, wherein the pair of inductors have equal inductances.

12. The method of claim 10, wherein the composite load comprises two groups of inductors having equal inductances, and wherein one of the two groups of inductors comprises one of the pair of inductors and the other of the two groups of inductors comprises the other of the pair of inductors.

13. The method of claim 10, wherein the inductance of the at least one inductor is selected such that total inductance of the composite load permits the transmitter to have a slew rate sufficient for the frequency of the acoustic signal.

14. The method of claim 10, wherein the voltage is applied to the composite load via switching circuitry controlled by the drive signal, the voltage being applied across the composite load in a forward polarity when the drive signal is in a first state and in a reverse polarity when the drive signal is in a second state.

15. The method of claim 14, wherein the switching circuitry comprises an H-bridge comprising power transistors as switches and a freewheeling diode placed across the output terminals of each of the power transistors.

16. The method of claim 14, wherein the drive signal is modulated using pulse width modulation.

17. A drilling tool comprising an acoustic transmitter for transmitting an acoustic signal through a drillstring, the transmitter comprising:

(a) a voltage source;

(b) a piezoelectric transducer and two metal shoulders constraining the piezoelectric transducer, the metal shoulders launching the acoustic signal into the drillstring when the piezoelectric transducer expands and contracts;

(c) charge control circuitry comprising a pair of inductors, wherein the piezoelectric transducer is connected in series between the pair of inductors, the piezoelectric transducer and the charge control circuitry collectively comprising a composite load; and (d) switching circuitry comprising:

(i) a control terminal for receiving a drive signal;

(ii) a supply terminal connected to the voltage source; and (iii) a pair of output terminals across which the composite load is connected, wherein voltage from the voltage source is applied across the output terminals in response to the drive signal, wherein total inductance of the charge control circuitry connected in series with the piezoelectric transducer is $$L = \frac{V_s}{V_p}\frac{T}{2\omega C}$$

wherein $V_s$ is the magnitude of the voltage from the voltage source, $V_p$ is a maximum voltage applied across the piezoelectric transducer, T is a period of the drive signal, C is a capacitance of the piezoelectric transducer, and ω is a radial frequency of the acoustic signal.

18. The drilling tool of claim 17, wherein the pair of inductors have equal inductances.

19. The drilling tool of claim 17, wherein the charge control circuitry comprises two groups of inductors having equal inductances, and wherein one of the two groups of inductors comprises one of the pair of inductors and the other of the two groups of inductors comprises the other of the pair of inductors.

20. The drilling tool of claim 17, wherein the voltage is applied across the output terminals in a forward polarity when the drive signal is in a first state, and the voltage is applied across the output terminals in a reverse polarity when the drive signal is in a second state.

21. The drilling tool of claim 17, wherein the switching circuitry comprises an H-bridge comprising power transistors as switches and a freewheeling diode placed across the output terminals of each of the power transistors.

22. The drilling tool of claim 17, further comprising a controller connected to the control terminal that outputs a pulse width modulation signal as the drive signal.

23. The drilling tool of claim 17, further comprising a battery electrically coupled to a DC to DC voltage converter whose output is connected to the supply terminal.

24. An acoustic transmission system for transmitting an acoustic signal through a drillstring, the system comprising:

(a) a transmitter located either within a downhole tool or on surface, the transmitter comprising:

(i) a voltage source;

(ii) a piezoelectric transducer and two metal shoulders constraining the piezoelectric transducer, the metal shoulders launching the acoustic signal into the drillstring when the piezoelectric transducer expands and contracts;

(iii) charge control circuitry comprising a pair of inductors, wherein the piezoelectric transducer is connected in series between the pair of inductors, the piezoelectric transducer and the charge control circuitry collectively comprising a composite load; and (iv) switching circuitry comprising:

(1) a control terminal for receiving a drive signal;

(2) a supply terminal connected to the voltage source; and (3) a pair of output terminals across which the composite load is connected, wherein voltage from the voltage source is applied across the output terminals in response to the drive signal;

(b) a receiver located within the downhole tool when the transmitter is on surface and located on surface when the transmitter is within the downhole tool, the receiver configured to receive the acoustic signal after propagating through the drillstring; and (c) a demodulator communicatively coupled to the receiver and configured to recover transmitted data from the received acoustic signal, wherein total inductance of the charge control circuitry connected in series with the piezoelectric transducer is $$L = \frac{V_s}{V_p}\frac{T}{2\omega C}$$

wherein $V_s$ is the magnitude of the voltage from the voltage source, $V_p$ is a maximum voltage applied across the piezoelectric transducer, T is a period of the drive signal, C is a capacitance of the piezoelectric transducer, and ω is a radial frequency of the acoustic signal.

25. A method for transmitting an acoustic signal through a drillstring, the method comprising applying a voltage across a composite load comprising a pair of inductors and a piezoelectric transducer connected in series between the pair of inductors in order to generate the acoustic signal, the piezoelectric transducer constrained by metal shoulders that launch the acoustic signal into the drillstring when the piezoelectric transducer expands and contracts in response to the voltage, wherein total inductance connected in series with the piezoelectric transducer is $$L = \frac{V_s}{V_p}\frac{T}{2\omega C}$$

wherein $V_s$ is the magnitude of the voltage from the voltage source, $V_p$ is a maximum voltage applied across the piezoelectric transducer, T is a period of the drive signal, C is a capacitance of the piezoelectric transducer, and ω is a radial frequency of the acoustic signal.

26. The method of claim 25, wherein the pair of inductors have equal inductances.

27. The method of claim 25, wherein the composite load comprises two groups of inductors having equal inductances, and wherein one of the two groups of inductors comprises one of the pair of inductors and the other of the two groups of inductors comprises the other of the pair of inductors.

28. The method of claim 25, wherein the voltage is applied to the composite load via switching circuitry controlled by the drive signal, the voltage being applied across the composite load in a forward polarity when the drive signal is in a first state and in a reverse polarity when the drive signal is in a second state.

29. The method of claim 28, wherein the switching circuitry comprises an H-bridge comprising power transistors as switches and a freewheeling diode placed across the output terminals of each of the power transistors.

30. The method of claim 28, wherein the drive signal is modulated using pulse width modulation.

* * * * *